US007465193B2

(12) United States Patent
Lin et al.

(10) Patent No.: US 7,465,193 B2
(45) Date of Patent: Dec. 16, 2008

(54) SHIELDED SURFACE MOUNT CONNECTOR

(75) Inventors: Kuo-Chin Lin, Tu-Cheng (TW); Hua-Lian Li, Tu-Cheng (TW); Feng Zhu, Tu-Cheng (TW); Hsin-Min Chao, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/697,268

(22) Filed: Apr. 5, 2007

(65) Prior Publication Data

US 2008/0248675 A1 Oct. 9, 2008

(51) Int. Cl.
*H01R 13/648* (2006.01)

(52) U.S. Cl. ..... 439/607; 439/629

(58) Field of Classification Search ..... 439/326, 439/329, 492, 497, 607, 629, 709
See application file for complete search history.

(56) References Cited

U.S. PATENT DOCUMENTS 6,319,026 B1 * 11/2001 Chen et al. ..... 439/108
6,676,449 B2 * 1/2004 Ji et al. ..... 439/607
7,121,887 B2 * 10/2006 Zhang et al. ..... 439/607

* cited by examiner

*Primary Examiner*—Renee S Luebke
*Assistant Examiner*—Vanessa Girardi
(74) *Attorney, Agent, or Firm*—Birch, Stewart, Kolasch & Birch, LLP

(57) ABSTRACT

A shielded surface mount connector mounted to a PCB includes a housing, a plurality of terminals and a shelter enclosing the housing. The housing provides a first protruding portion and a second protruding portion. The first and second protruding portions extend downwards respectively to form a first pillar and a second pillar. The shelter provides a first shielding portion and a second shielding portion for covering the first and second protruding portions respectively. The edges of the shielding portions extend downwards respectively to form a first inserting portion and a second inserting portion. As mentioned above, by inserting the first and second pillars and the two inserting portions into the corresponding holes of a PCB, the shielded surface mount connector is mounted to the edge of the PCB, which makes the electronic products much thinner due to the present invention, and saves more space of the PCB for other designs.

7 Claims, 5 Drawing Sheets

SHIELDED SURFACE MOUNT CONNECTOR

BACKGROUND OF THE INVENTION

1. Field of the Invention

This invention generally relates to a connector and more particularly to a connector mounted to a printed circuit board.

2. The Related Art

Electronic products have become more and more important in people's life as the electronic industry develops rapidly. In order to meet consumers' further request, the suppliers attempt to make the electronics shorter, smaller, lighter and thinner, which challenges the technique of connector industry.

When a conventional connector is assembled to a printed circuit board, it always be mounted on the surface of the printed circuit board. Correspondingly, the connector has inserting portions or fixing portions extending downwards from the bottom of the housing or shelter of the connector for mounting on the printed circuit board.

However, as the bottom of the conventional connector is mounted on the printed circuit board, the electronic products will be thicken, which is not fit the trend of the electronic development. What's more, the conventional connector takes up much space on the printed circuit board, leaving little space for other designs.

SUMMARY OF THE INVENTION

In view of the foregoing, the present invention is proposed to provide a connector to conquer the disadvantage mentioned above. The present invention of connector comprises a housing, a plurality of terminals received in the housing and a shelter enclosing the housing. The housing has a main body. The upper portions of the opposite sides of the main body extend forwards respectively to form a first protruding portion and a second protruding portion. The first and second protruding portions extend downwards respectively to form a first pillar and a second pillar. The bottom of the first and second pillars has a same height with the bottom surface of the main body. The shelter has a top plate, a bottom plate and two side plates. The opposite sides of the top plate extend forwards to form a first shielding portion and a second shielding portion. The first and second shielding portions cover the first and second protruding portions respectively. The edges of the first and second shielding portions extend downwards respectively to form a first inserting portion and a second inserting portion. The bottom of the two inserting portions is lower than the pillars.

As described above, by inserting the first and second pillars of the housing and the inserting portions and into the corresponding holes of a PCB, the connector of the present invention is mounted to the edge of the PCB, which makes the electronic products apply to the present invention much thinner. Hence, more space of the PCB is left for other designs.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
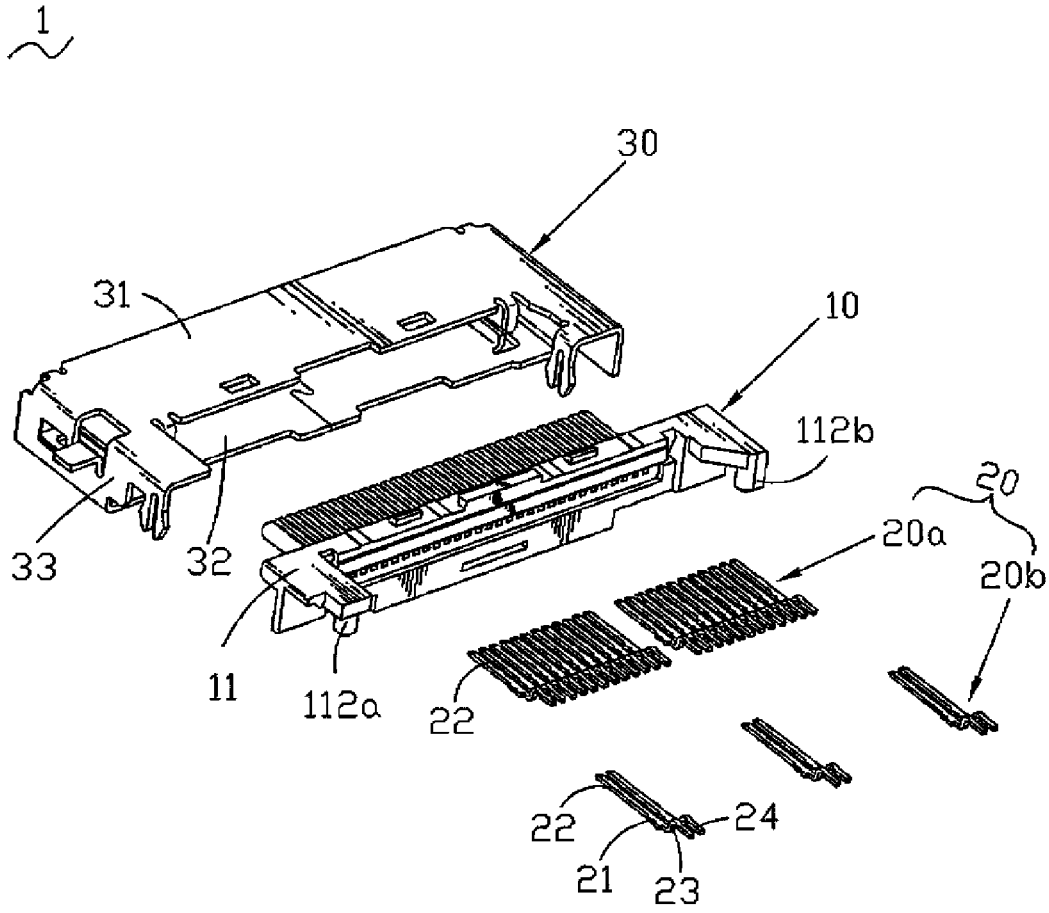
FIG. 1 is an exploded view of a connector in accordance with the present invention.

Referring to FIG. 1, a connector 1 according to the present invention includes a housing 10, a plurality of terminals 20 parallel-arranged in the housing 10 and a shelter 30 made of metal materials enclosing the housing 10.

Figure 2:
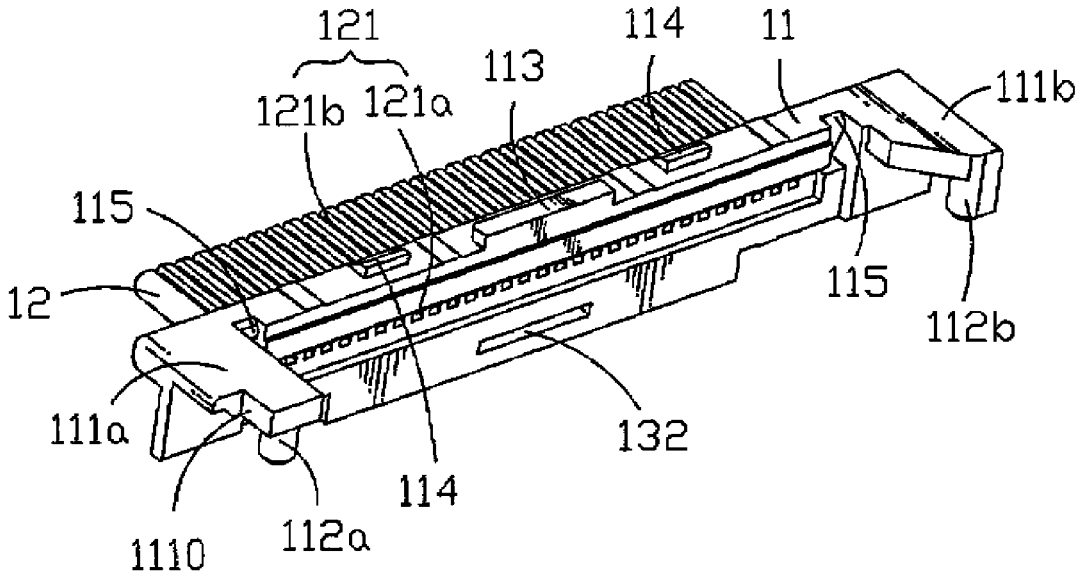
FIG. 2 is a perspective view of a housing of the connector in accordance with the present invention.

With reference to FIG. 2, the housing 10 is a one-piece structure molded of dielectric materials, which includes a transverse main body 11. Two opposite sides of the main body 11 extend forwards to form a first protruding portion 111*a* and a second protruding portion 111*b* in a same length. The front end of the first protruding portion 111*a* is hollowed out to form a rectangular jag 1110 at the outer corner. The inner side of the front end of the first protruding portion 111*a* extends downwards to form a first pillar 112*a* beside the jag 1110. The inner edge of the front end of the second protruding portion 111*b* is beveled. A second pillar 112*b* extends downwards from the outer side of the second protruding portion 111*b*. Both pillars 112*a* and 112*b* extend downwards to the bottom surface of the housing 10.

The top surface of the main body 11 protrudes a first projection 113 at the lateral middle. The front end of the first projection 113 is flushed with the front end of the main body 11, and the back end melts in the longitudinal middle of the top surface of the main body 11. The top surface of the main body 11 protrudes upwards to form two second projections 114 at the two sides of the first projection 113. The front end of the second projection 114 melts in the longitudinal middle of the top surface of the main body 11, and the back end is flushed with the back end of the main body 11. A plurality of terminal holes 121*a* are defined in a horizontal line in the main body 11. A compressed body 12 in a tabular structure is located to the backside of the main body 11 corresponding to the terminal holes 121*a*. A plurality of terminal slots 121*b* are defined in the compressed body 12. Each terminal hole 121*a* communicates with the corresponding terminal slot 121*b* to compose a terminal-receiving passage 121 together for receiving the terminal 20. Two notches 115 adjacent to the corresponding protruding portions 111*a*, 111*b* are formed at two sides of the front end of the main body 11.

Figure 3:
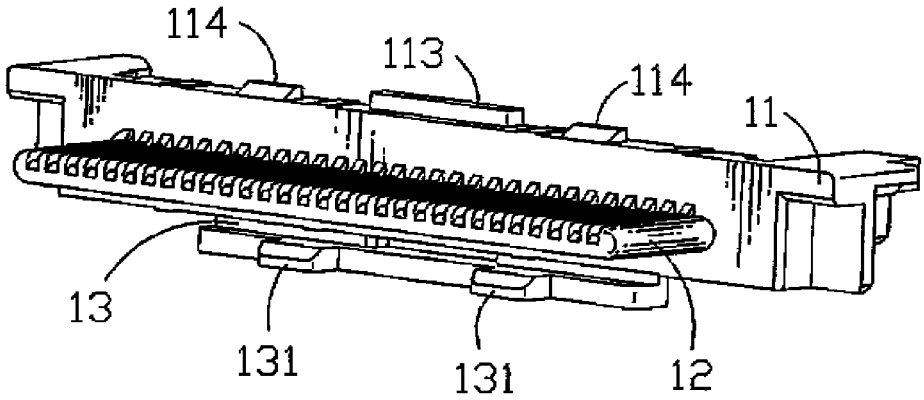
FIG. 3 is another perspective view of the housing of the connector in accordance with the present invention.

Referring to FIG. 3, the lateral middle of the main body 11 extends downwards and then backwards to form a clamping portion 13. The back edge of the clamping portion 13 protrudes two bulges 131 at the two sides of the bottom. The clamping portion 13 defines a clamping slot 132 which runs through the clamping portion 13 from front to back.

Figure 4:
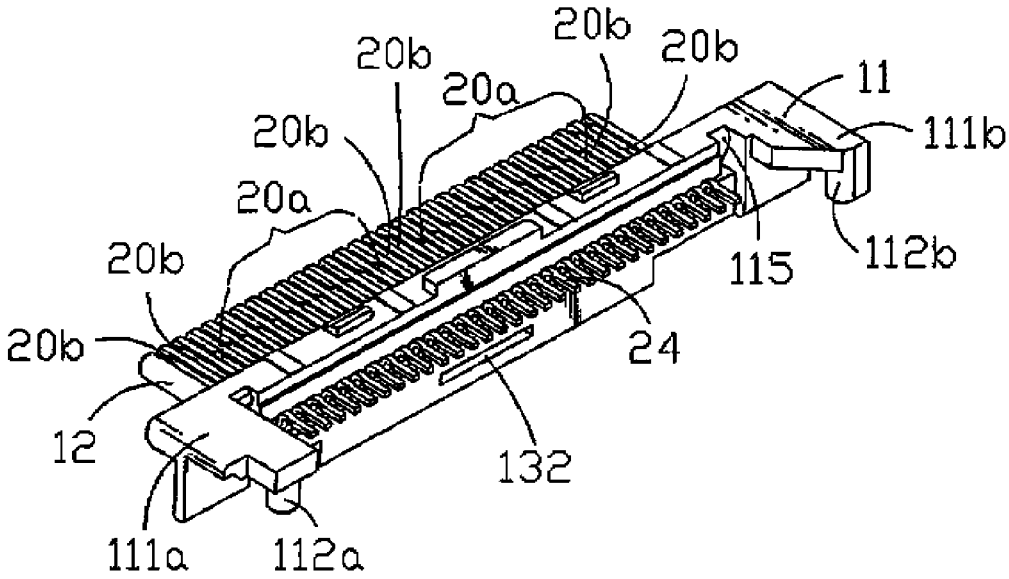
FIG. 4 is a perspective view showing the assembly of a plurality of terminals and the housing.

As shown in FIGS. 1 and 4, each terminal 20 comprises a flat grasping portion 21, a slender contacting portion 22 extending from the back of the grasping portion 21, a "S" shape bending portion 23 extending from the back of the contacting portion 22, and a mounting portion 24 extending from the end of the bending portion 23. When the terminal 20 is assembled into a terminal-receiving passage 121, the grasping portion 21 is contained in the terminal hole 121*a* and the contacting portion 22 is contained in the terminal slot 121*b* for connecting with a mating connector device (not shown). The mounting portion 24 is exposed beyond the front surface of the main body 11 for being mounted to a PCB (not shown).

The terminals 20 can be further divided into conductive terminals 20*a* and ground terminals 20*b*. The two types of terminals 20 share the same structure. The difference between the conductive terminal 20*a* and the ground terminal 20*b* lies in the contacting portion 22. The contacting portion 22 of the ground terminal 20*b* is longer than that of the conductive terminal 20*a*. In assembly, the ground terminal 20*b* is received into the terminal-receiving passages 121 at the middle and two sides.

Figure 5:
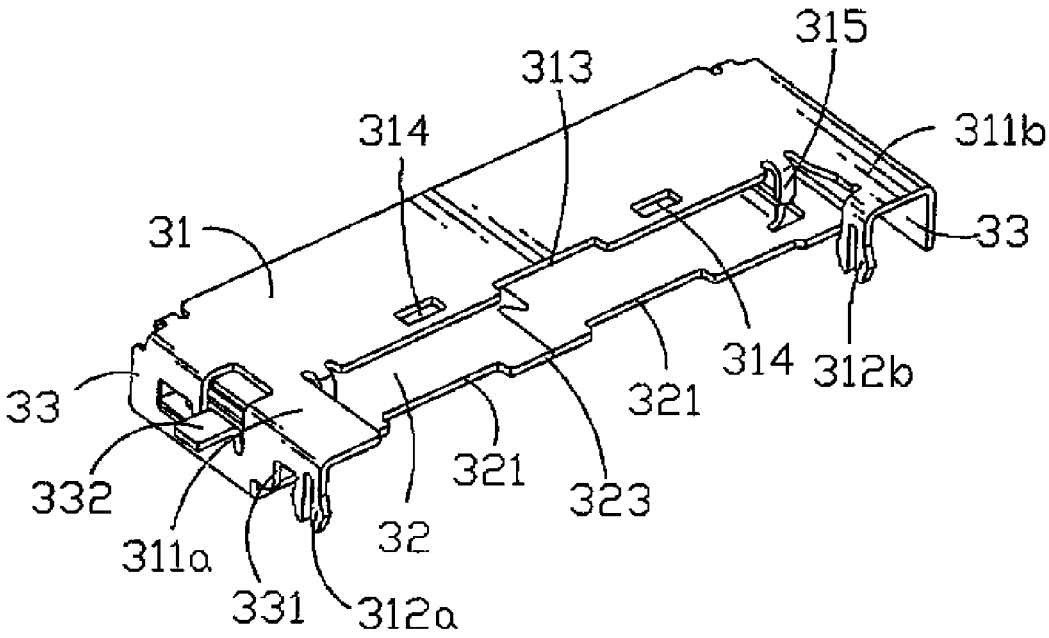
FIG. 5 is a perspective view of a shelter of the connector in accordance with the present invention.
Figure 6:
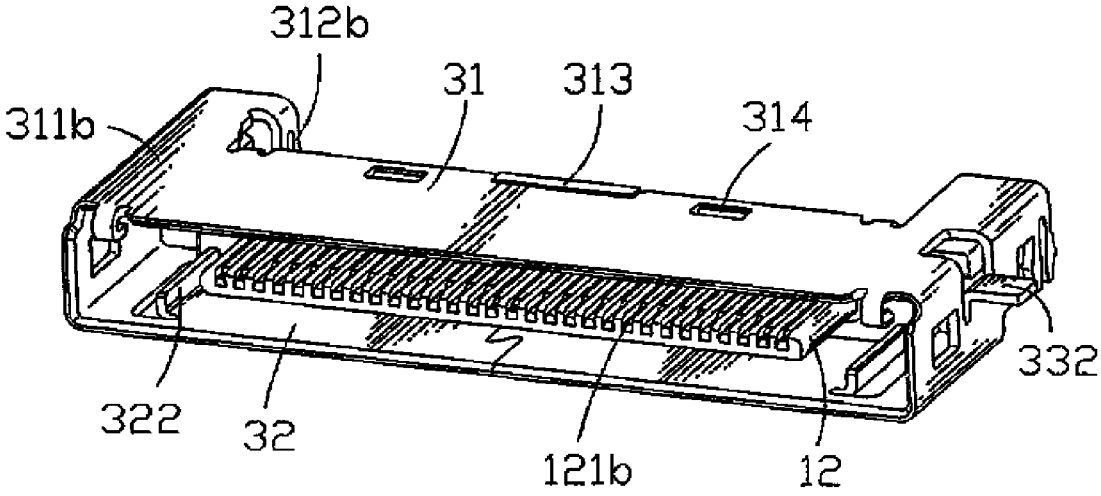
FIG. 6 is a perspective view of the connector in accordance with the present invention.
Figure 7:
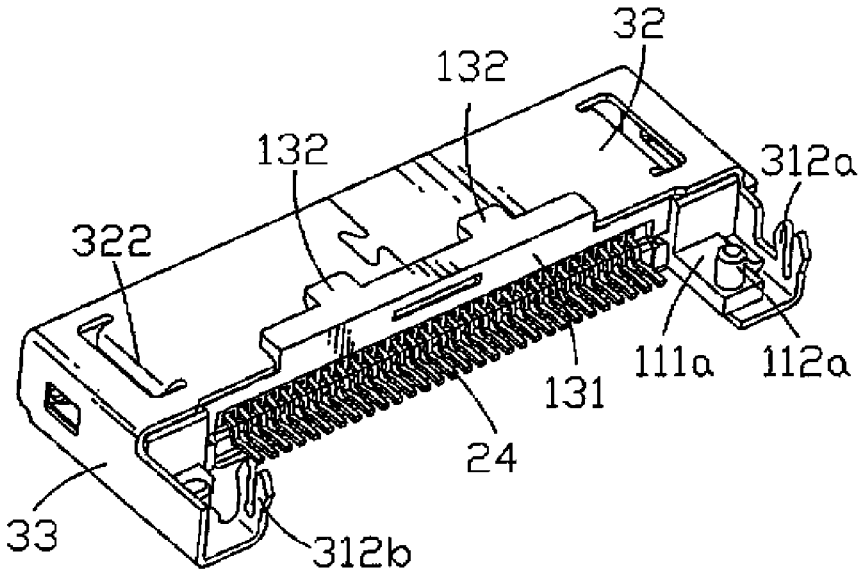
FIG. 7 is another perspective view of the connector in accordance with the present invention.

Referring to FIG. 5, the shelter 30 defines corresponding structures to enclose the housing 10. The shelter 30 has a top plate 31, a bottom plate 32 and two side plates 33. Two sides of the top plate 31 extend forwards respectively to form a first shielding portion 311*a* and a second shielding portion 311*b* for shielding the first and second protruding portions 111*a* and 111*b*. The outer edge of the first shielding portion 311*a* extends downwards to form a first inserting portion 312*a*. A first gap 331 is defined between the first inserting portion 311*a* and the corresponding side plate 33. The outer side of the second shielding portion 311*b* is melt with the corresponding side plate 33; the inner edge of the second shielding portion 311*b* extends downwards to form a second inserting portion 312*b*. Both inserting portions 312*a* and 312*b* have a same height with the bottom plate 32, which are lower than the pillars 112*a* and 112*b* of the housing 10. In assembly, the first inserting portion 312*a* is located at the outer side of the first pillar 112*a* and the second inserting portion 312*b* is located at the inner side of the second pillar 112*b*.

Figure 8:
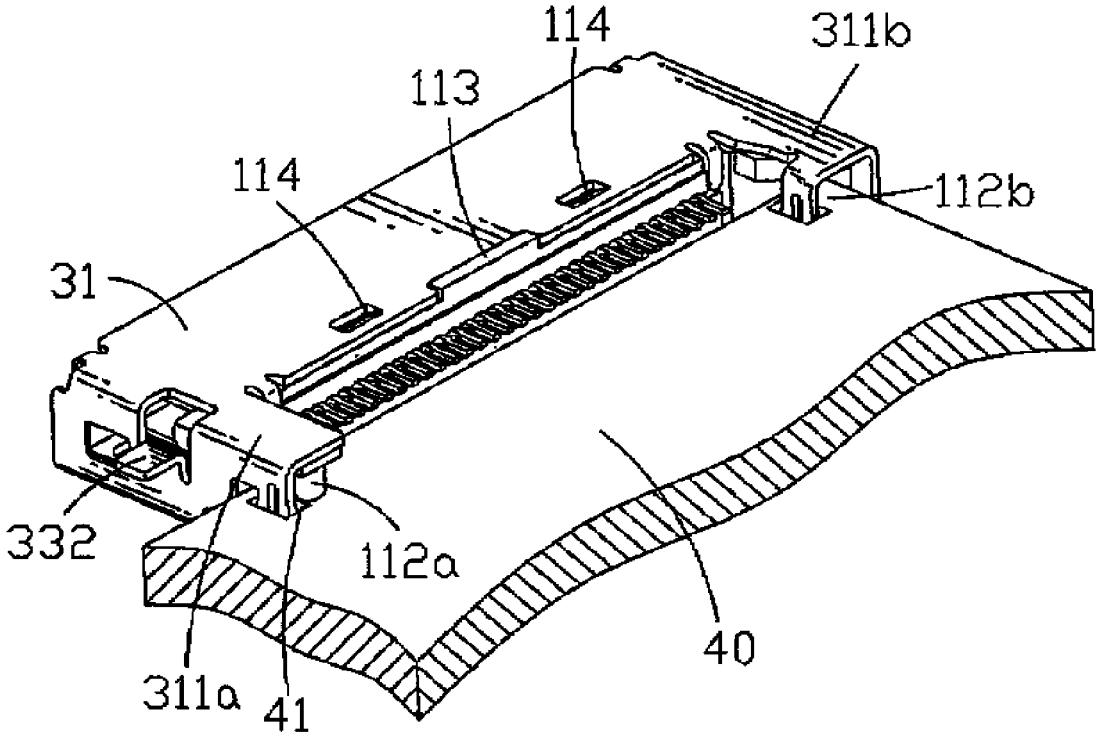
FIG. 8 is a perspective view of the connector mounted to the edge of a PCB in accordance with the present invention.

The first and second inserting portions 312*a*, 312*b* both include two inserting pieces. The inserting piece has a vertical edge at the inner side and a shuttle shape edge protruding outwards at the middle of the outer side. Two inserting pieces of the inserting portion 312*a* or 312*b* are located with a certain width apart to ensure the inserting portions 321*a* and 312*b* blocking the corresponding holes defining on a PCB 40 (as shown in FIG. 8). In the provided embodiment, the inserting portions are defined at the side edges, but it should be understood that the inserting portions 312*a* and 312*b* are not limited to be defined as above, for example, the front ends of the first and second shielding portion 311*a* and 311*b* are also appropriate to protrude inserting portions for being assembled to the PCB 40.

Referring to FIGS. 5 to 8, the top plate 31 of the shelter 30 forms a second gap 313 at the middle of the front end to match the first projection 113 for preventing the shelter 30 from moving forwards when assembled. Two clench holes 314 are defined at two sides of the second gap 313 to block the second projections 114 to help engaging the housing 10. Two thin and long slats 315 protrude forwards at the inner side of the shielding portion 311*a* and 311*b* and then bends downwards to be locked at the corresponding notches 115 of the housing 10 for preventing the housing 10 from moving forwards when assembled. Two sunken portions 321 are formed at a front end of the bottom plate 32; a projecting piece 323 is defined between the sunken portions 321. In assembly, the clamping portion 13 is clamped at the sunken portions 321, the bulges 131 clutches the bottom plate 32 and the projecting piece 323 are contained in the clamping slot 132, therefore, the shelter 30 and the housing 10 are engaged with each other. A clipping slice 332 protrudes outwards at the middle of one side plate 33 to keep the connector 1 level when the connector 1 is mounted to a PCB 40.

Please refer to FIG. 8. As described above, by inserting the first and second pillars 112*a* and 112*b* of the housing 10 and the inserting portions 312*a* and 312*b* into the corresponding holes 41 of the PCB 40, the connector 1 of the present invention is mounted to the edge of the PCB, which makes the electronic products apply to the present invention much thinner. Hence, more space of the PCB is left for other designs.

Although preferred embodiment of the present invention have been described in detail hereinabove, it should be clearly understood that many variations and/or modifications of the basic inventive concepts herein taught which may appear to those skilled in the present art will fall within the spirit and scope of the present invention, as defined in the appended claims.

What is claimed is:

1. A connector comprising:

a housing having a main body, wherein opposite sides of an upper portion of the main body respectively extend forward to form a first protruding portion and a second protruding portion, the first and second protruding portions further extend downward to form a first pillar and a second pillar, each terminating with a free end that shares the same plane as a bottom surface of the main body, the housing having a plurality of terminal passages defined therein;

a plurality of terminals received in the terminal passages respectively; and a shelter enclosing the housing, having a top plate, a bottom plate and two side plates, the opposite sides of the top plate extend forward to form a first shielding portion and a second shielding portion, the first and second shielding portions covering the first and second protruding portions respectively, the first and second shielding portions further extend downward to form a first inserting portion and a second inserting portion, wherein the two inserting portions extend beyond the pillars.

2. The connector as claimed in claim 1, wherein the first and second inserting portions include two inserting pieces, each inserting piece comprising a vertical edge on an inner side and a shuttle shaped edge protruding outwards midway along an outer side, the two inserting pieces located a certain distance apart.

3. The connector as claimed in claim 1, wherein the first inserting portion extends downward from an outer edge of the first shielding portion, the second inserting portion extends downwards from an inner edge of the second shielding portion, the first inserting portion located along an outer side of the first pillar and the second inserting portion located along an inner side of the second pillar.

4. The connector as claimed in claim 1, wherein the main body further includes a top surface having three equally spaced, laterally centered, upward protrusions forming first and second projections; wherein the top plate of the shelter defines a laterally centered second gap to match the first projection, and a clench hole is defined on each lateral side of the first gap to engage with the second projections.

5. The connector as claimed in claim 1, wherein two lateral sides of the main body on a front end thereof, further defines two notches adjacent the corresponding protruding portions; wherein two slats protrude from a forward inner edge of the first and second shielding portions capable of bending downward into the corresponding notches preventing the housing from moving forward when assembled with the shelter.

6. The connector as claimed in claim 1, wherein a lateral middle portion of the main body extends downward and backward to form a clamping portion, the clamping portion defines a clamping slot which runs through the clamping portion from front to back, and the shelter further includes two sunken portions formed at a back edge of the bottom plate, and a projecting piece is defined between the sunken portions; such that the sunken portions of the shelter abut the clamping portion of the main body when the projecting piece is inserted into the clamping slot.

7. The connector as claimed in claim 6, wherein a backward edge of the clamping portion further protrudes forming two laterally spaced bulges which clutch the bottom plate of the shelter.

* * * * *